US007509690B2

(12) United States Patent
Steward

(10) Patent No.: US 7,509,690 B2
(45) Date of Patent: Mar. 31, 2009

(54) WATER-SOLUBLE GLOVE LINERS AND COMPOSITE GLOVES CONTAINING THE SAME

(76) Inventor: John B. Steward, 15 Mountain Rd., Sedona, AZ (US) 86351

( * ) Notice: Subject to any disclaimer, the term of this patent is extended or adjusted under 35 U.S.C. 154(b) by 69 days.

(21) Appl. No.: 11/330,542

(22) Filed: Jan. 12, 2006

(65) Prior Publication Data

US 2008/0005827 A1 Jan. 10, 2008

Related U.S. Application Data

(63) Continuation-in-part of application No. PCT/US2004/028839, filed on Sep. 7, 2004, and a continuation-in-part of application No. 10/657,359, filed on Sep. 8, 2003, now Pat. No. 7,328,463.

(51) Int. Cl.
*A41D 19/00* (2006.01)

(52) U.S. Cl. ..... 2/161.1; 2/163

(58) Field of Classification Search ..... None
See application file for complete search history.

(56) References Cited

U.S. PATENT DOCUMENTS

| | | | | |
|---|---|---|---|---|
| 3,950,789 | A | 4/1976 | Konz et al. | |
| 4,033,354 | A | 7/1977 | De Rosa | |
| D292,140 | S | 10/1987 | Cahill et al. | |
| 4,738,119 | A | 4/1988 | Zafred | |
| 4,777,789 | A * | 10/1988 | Kolmes et al. | 57/210 |
| D305,700 | S | 1/1990 | Werner | |
| 4,902,558 | A | 2/1990 | Henriksen | |
| 5,062,161 | A * | 11/1991 | Sutton | 2/169 |
| 5,181,967 | A | 1/1993 | Honeycutt | |
| 5,442,815 | A * | 8/1995 | Cordova et al. | 2/161.7 |
| 5,511,246 | A | 4/1996 | Farkas et al. | |
| D384,788 | S | 10/1997 | Curry | |
| 5,780,098 | A | 7/1998 | Battles | |
| 5,799,333 | A * | 9/1998 | McGarry et al. | 2/161.6 |
| 5,806,295 | A * | 9/1998 | Robins et al. | 57/220 |
| 5,869,193 | A * | 2/1999 | Langley | 428/520 |
| RE36,399 | E | 11/1999 | Honeycutt | |
| D453,055 | S | 1/2002 | Ode | |
| 6,341,384 | B1 | 1/2002 | Hayes | |
| D456,115 | S | 4/2002 | Johnston | |
| 6,803,332 | B2 * | 10/2004 | Andrews | 442/197 |
| 6,854,135 | B2 * | 2/2005 | Jones et al. | 2/456 |
| 6,880,319 | B2 * | 4/2005 | Zhu | 57/3 |
| 6,962,064 | B1 * | 11/2005 | Hardee et al. | 66/174 |
| 7,000,295 | B2 * | 2/2006 | Andrews | 28/168 |
| 2004/0210167 | A1 * | 10/2004 | Webster | 601/1 |

FOREIGN PATENT DOCUMENTS

| | | |
|---|---|---|
| DE | 4132804 | 10/1995 |

OTHER PUBLICATIONS

Japanese Abstract, Hirosuke, "Nonwoven Fabric Soluble in Hot Water", Nippon Synthetic Chem. In. Co. Ltd., No. 9, Apr. 27, 1999.

* cited by examiner

*Primary Examiner*—Katherine Moran
(74) *Attorney, Agent, or Firm*—Withers & Keys, LLC

(57) ABSTRACT

Water-soluble glove liners and methods of making, using and disposing of the water-soluble glove liners are disclosed.

9 Claims, 5 Drawing Sheets

WATER-SOLUBLE GLOVE LINERS AND COMPOSITE GLOVES CONTAINING THE SAME

CROSS-REFERENCE TO RELATED APPLICATIONS

This patent application (i) claims the benefit of priority to and is a continuation-in-part of International Patent Application Serial No. PCT/US04/028839 filed on Sep. 7, 2004, and (ii) claims the benefit of priority to and is a continuation-in-part of U.S. patent application Ser. No. 10/657,359, filed on Sep. 8, 2003 now U.S. Pat. No. 7,328,463, the subject matter of both of which is hereby incorporated by reference in its entirety.

FIELD OF THE INVENTION

The present invention relates to water-soluble glove liners and composite gloves containing the same. The present invention further relates to methods of making and using water-soluble glove liners.

BACKGROUND OF THE INVENTION

There exists a need in the art for glove liners that can be efficiently and effectively disposed of while minimizing the amount of contaminants resulting from such disposal.

SUMMARY OF THE INVENTION

The present invention addresses some of the difficulties and problems discussed above by the discovery of water-soluble glove liners. In one exemplary embodiment, the water-soluble glove liner of the present invention comprises one or more fabric sheets, wherein when more than one fabric sheet is used to form the water-soluble glove liner, the fabric sheets are joined to one another with one or more sheet fastening devices, wherein each of the one or more fabric sheets comprises a water-soluble fabric formed from water-soluble polyvinyl alcohol fibers. Each of the one or more fabric sheets may comprise a knitted, woven, or nonwoven water-soluble fabric sheet.

In another exemplary embodiment, the water-soluble glove liner of the present invention comprises two or more knitted fabric sheets joined to one another with one or more sheet fastening devices, wherein each of the two or more knitted fabric sheets comprises a water-soluble knitted fabric comprising water-soluble polyvinyl alcohol fibers.

The water-soluble glove liners of the present invention may be used in an unlimited number of industries and applications, and find particular usefulness in the nuclear industry.

The present invention is further directed to composites gloves comprising water-soluble glove liners. In one exemplary embodiment, the composite glove of the present invention comprises a water-soluble glove liner in combination with a glove with the glove being sized so as to be positioned over at least a portion of an outer surface of the water-soluble glove liner, wherein the water-soluble glove liner comprises one or more fabric sheets, wherein when more than one fabric sheet is used to form the water-soluble glove liner, the fabric sheets are joined to one another with thread, wherein each of the one or more fabric sheets comprises a water-soluble fabric comprising water-soluble fibers.

The present invention is even further directed to methods of making and using water-soluble glove liners and composite gloves. In one exemplary method, the water-soluble glove liners are used for a particular purpose, and then disposed of by solubilizing the water-soluble material of the water-soluble glove liner.

The present invention is also directed to methods of disposing of a water-soluble glove liner, wherein the method comprises exposing the water-soluble glove liner to an aqueous bath under condition such that the water-soluble material becomes soluble. The method may comprise a number of additional steps including separating the solubilized water-soluble material from any contaminants on the glove liner via, for example, a filtration step. In one exemplary embodiment of the present invention, the method is used to remove one or more contaminants (e.g., radioactive material) from a water-soluble glove liner used in the nuclear industry.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

I. Water-Soluble Glove Liners

Figure 1:
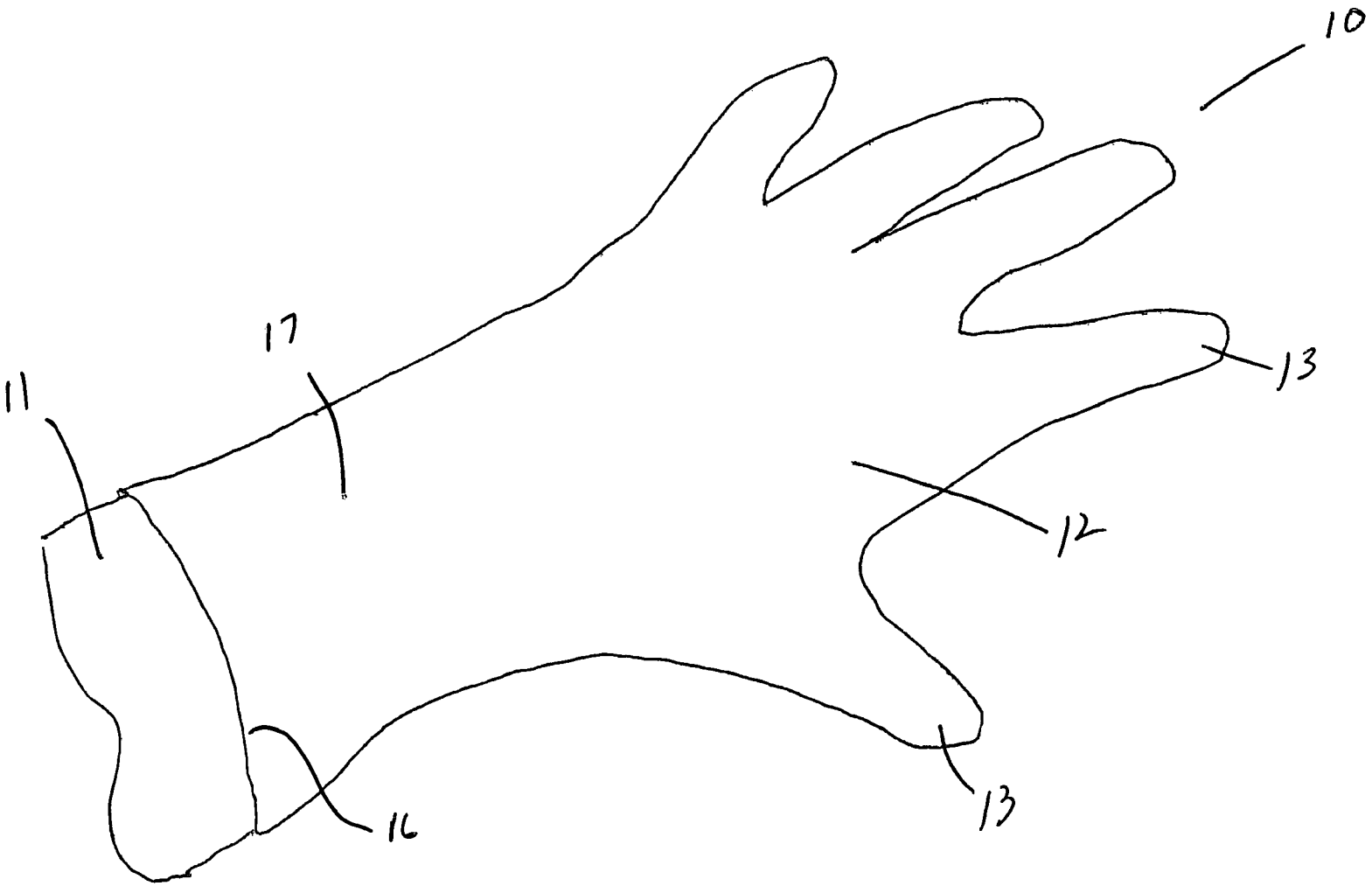
FIG. 1 depicts a view of an exemplary glove liner of the present invention.
Figure 3:
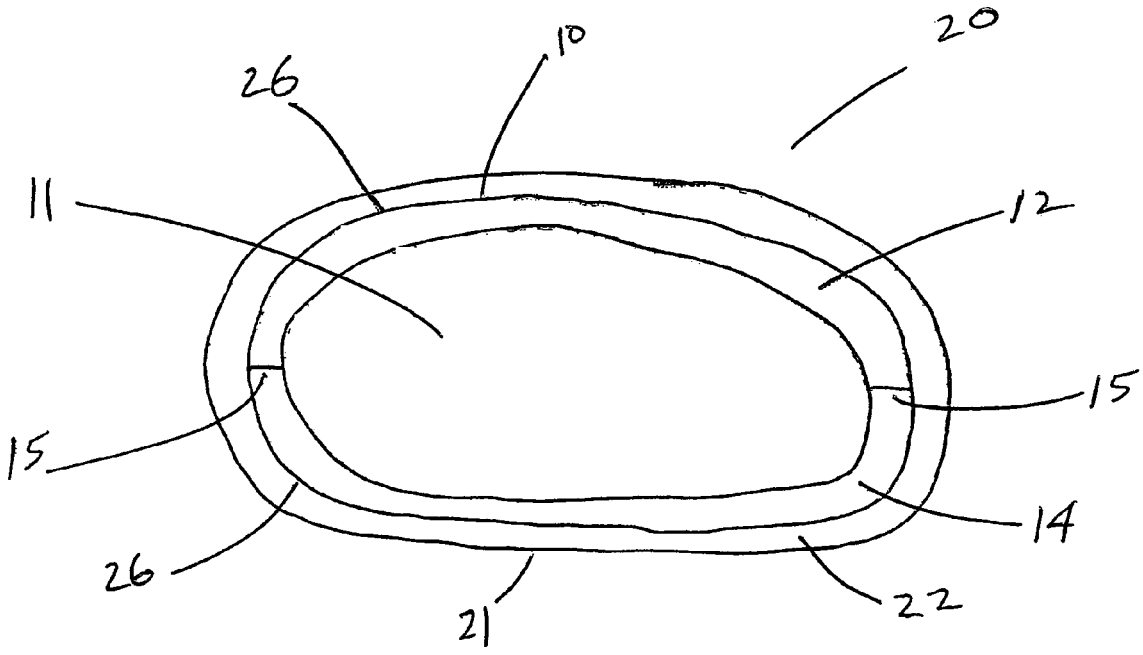
FIG. 3 depicts a cross-sectional view of the exemplary composite glove of FIG. 2 along line A-A.

The present invention is directed to water-soluble glove liners and methods of using the water-soluble glove liners. An exemplary water-soluble glove liner is shown in FIG. 1. As shown in FIG. 1, exemplary water-soluble glove liner 10 may be worn over a person's hand 11 and comprises at least one fabric sheet, upper fabric sheet 12, and fingers 13. As shown in FIG. 3, exemplary water-soluble glove liner 10 also comprises lower fabric sheet 14 connected to upper fabric sheet 12 along seams 15 via one or more sheet fastening devices (not shown).

A description of each of the water-soluble glove liner components is provided below.

A. Water-Soluble Glove Components

The water-soluble glove liners of the present invention comprise one or more of the following components.

a. Water-Soluble Material

The water-soluble glove liners of the present invention comprise water-soluble material. As used herein, the term "water-soluble" refers to materials having a degree of solubility in water at a water temperature of about 37° C. or above (or at or above about 50° C., or at or above about 75° C., or at or above about 90° C.).

Suitable water-soluble materials for use in the present invention include, but are not limited to, polyvinyl alcohol; polyacrylic acid; polymethacrylic acid; polyacrylamide; water-soluble cellulose derivatives such as methyl celluloses, ethyl celluloses, hydroxymethyl celluloses, hydroxypropyl methyl celluloses, and carboxymethyl celluloses; carboxymethylchitin; polyvinyl pyrrolidone; ester gum; water-soluble derivatives of starch such as hydroxypropyl starch and carboxymethyl starch; and water-soluble polyethylene oxides. Suitable alkali water-soluble materials for use in the present invention include, but are not limited to, ethylene copolymers of acrylic acid (EAA) and methacrylic acid (EMAA), and salts thereof; and ionomers containing acrylic acid and/or methacrylic acid. Desirably, the water-soluble material comprises polyvinyl alcohol with or without acetyl groups, cross-linked or uncross-linked. Suitable polyvinyl alcohol materials are described in U.S. Pat. Nos. 5,181,967; 5,207,837; 5,268,222; 5,620,786; 5,885,907; and 5,891,812; the disclosures of all of which are hereby incorporated in their entirety by reference.

The water-soluble glove liners of the present invention may contain any of the above-described water-soluble materials alone or in combination with any of the water-insoluble materials described in U.S. patent application Ser. No. 10/657,359, the subject matter of which is hereby incorporated by reference in its entirety. Desirably, the construction of the water-soluble glove liner is such that each component of the glove liner (e.g., fabric components, sheet fastening devices, sheet closure systems, etc.) either (1) completely dissolves or (2) breaks up into small particles/pieces when exposed to conditions, which cause the water-soluble component(s) of the glove liner to become soluble.

In some embodiments of the present invention, the water-soluble glove liner comprises water-soluble material alone or in combination with water-insoluble material. When water-insoluble materials are used to form a water-soluble glove liner of the present invention, desirably less than about 50 parts by weight (pbw) of water-insoluble material is used in combination with at least about 50 parts by weight (pbw) of water-soluble material to form the water-soluble glove liner, based on the total parts by weight of the water-soluble glove liner. More desirably, the water-soluble glove liner comprises at least about 70 pbw of water-soluble material and less than about 30 pbw of water-insoluble material, even more desirably, at least about 90 pbw of water-soluble material and less than about 10 pbw of water-insoluble material, based on a total parts by weight of the water-soluble glove liner.

In a further embodiment, the water-soluble glove liner consists essentially of water-soluble material. In yet a further embodiment, the water-soluble glove liner consists of water-soluble material.

In one embodiment, the water-soluble glove liner comprises one or more sheets of nonwoven fabric formed from water-soluble fibrous material. Desirably, the one or more sheets of nonwoven fabric comprise spunbonded or spunlaced polyvinyl alcohol fibers. Alternatively, the nonwoven fabric may be formed by one or more of the following processes: melt-blowing; dry carding and hydroentangling; thermally bonding; dry laying and carding followed by needle-punching; carding; chemical bonding; needle-punching; or any combination thereof.

In still a further embodiment, the water-soluble glove liner comprises one or more sheets of woven fabric formed by weaving water-soluble fibers, such as water-soluble polyvinyl alcohol fibers. In yet another embodiment, the water-soluble glove liner comprises one or more sheets of knitted fabric formed by knitting water-soluble fibers, such as water-soluble polyvinyl alcohol fibers. Any known technique for knitting and/or weaving fibers may be employed to form the water-soluble glove liners of the present invention.

In one desired embodiment of the present invention, the water-soluble glove liner comprises one or more sheets of knitted fabric formed by knitting water-soluble polyvinyl alcohol fibers. Each of the knitted sheets may be formed using the product specifications as shown in the table below.

| Specification Parameter | Desired Value |
|---|---|
| yarn fineness | 32 s |
| fabric structure | tabby knitting |
| fabric basis weight | 105 ± 5 g/m$^2$ |
| residuals after fabric is dissolved | ≦2% |
| dissolution temperature | 90~97° C. |
| fabric color | natural white |

Desirably, each of the knitted sheets used to form the water-soluble glove liner of the present invention has a basis weight of from about 65 g/m$^2$ to about 155 g/m$^2$, and desirably about 105 g/m$^2$. Further, desirably each of the knitted sheets used to form the water-soluble glove liner of the present invention has a yarn fineness of less than about 16, and more desirably about 32.

The water-soluble glove liner of the present invention can have any given overall dimensions. In one desired embodiment, the water-soluble glove liner has an overall length of about 30 cm, an opening (for insertion of a person's hand) having a width of about 11.5 cm, a finger (e.g., finger 13) length of up to about 12 cm, and a finger width of up to about 3.1 cm.

In further desired embodiments of the present invention, the water-soluble glove liner comprises at least one fabric layer, at least one film layer, or a combination thereof, wherein each of the layers comprises, consists essentially of, or consists of polyvinyl alcohol (PVA). The polyvinyl alcohol may be in fibrous form or film form. Suitable PVA fibers and films and methods of making PVA fibers and films are disclosed in U.S. Pat. Nos. 5,181,967; 5,207,837; 5,268,222; 5,620,786; 5,885,907; and 5,891,812; the disclosures of all of which are hereby incorporated in their entirety by reference. An example of a suitable water-soluble polyvinyl alcohol fiber for use in the present invention is a polyvinyl alcohol homopolymer that has been highly crystallized by post-drawing or by heat annealing.

In one desired embodiment of the present invention, the water-soluble glove liner comprises one or more fabric sheets, wherein each of the one or more fabric sheets consists essentially of water-soluble polyvinyl alcohol fibers. In a further desired embodiment of the present invention, the water-soluble glove liner comprises one or more fabric sheets, wherein each of the one or more fabric sheets consists of water-soluble polyvinyl alcohol fibers.

Desirably, the one or more fabric sheets used to form the water-soluble glove liner comprise water-soluble fibers that are soluble in water having a water temperature of greater than about 37° C. (or greater than about 50° C., or greater than about 75° C., or greater than about 90° C.). More desirably, the one or more fabric sheets used to form the water-soluble glove liner comprise water-soluble polyvinyl alcohol fibers (e.g., water-soluble fibers comprising 100% water-soluble polyvinyl alcohol material) that are soluble in water having a water temperature of greater than about 37° C. (or greater than about 50° C., or greater than about 75° C., or greater than about 90° C.).

b. Sheet Fastening Devices

The water-soluble glove liners of the present invention may comprise one or more sheet fastening devices to connect one or more fabric sheets to one another. Suitable sheet fastening devices include, but are not limited to, thread, adhesives, hoop and loop materials, or a combination thereof. Desirably, when two or more of the above-described fabric sheets are used to form the water-soluble glove liners of the present invention, the two or more fabric sheets are attached to one another using thread. Suitable thread includes, but is not limited to, thread comprising any of the above-described water-soluble materials, thread comprising water-insoluble materials, or a combination thereof.

In one exemplary embodiment of the present invention, the thread used to connect two or more fabric sheets together comprises a polyester thread such as polyethylene terephthalate (PET) thread. In a further exemplary embodiment of the present invention, the thread used to connect two or more fabric sheets together comprises polyvinyl alcohol (PVA) thread.

c. Closure System

The water-soluble glove liners of the present invention may further comprise one or more sheet closure systems to temporarily attach a portion of a water-soluble glove liner to another portion of the water-soluble glove liner (e.g., a closure system to enable a tightened fit around a person's wrist). Suitable closure systems include, but are not limited to, one or more zippers, drawstrings, snaps, buttons, adhesives, hoop and loop materials, or a combination thereof.

Figure 5A:
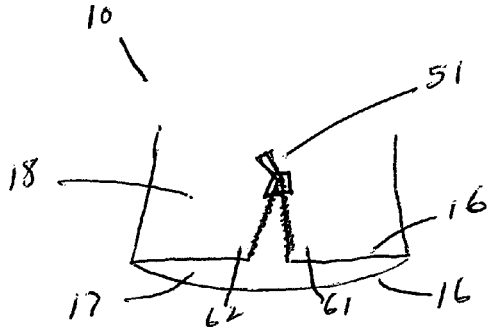
FIGS. 5A-5F depict various exemplary closure systems suitable for attaching one portion of a glove liner to another portion of the same glove liner.
Figure 5B:
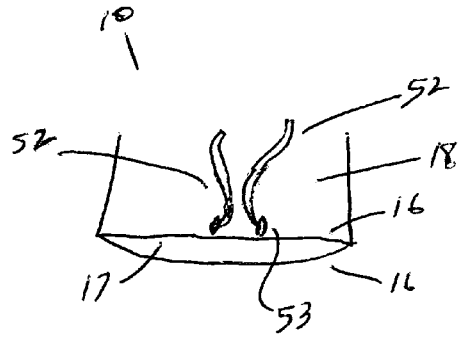
Figure 5C:
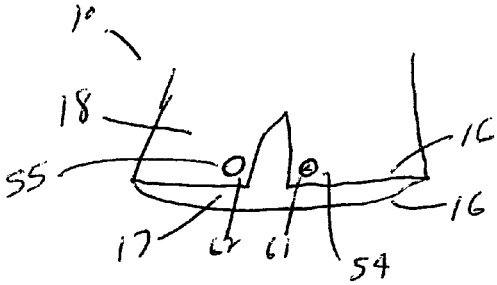
Figure 5D:
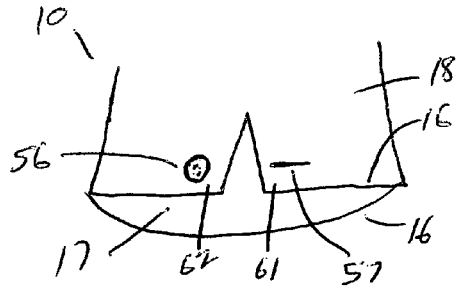
Figure 5E:
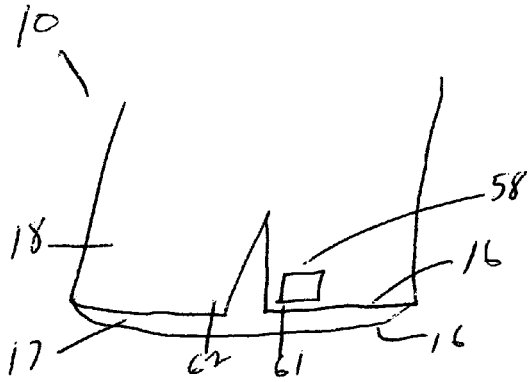
Figure 5F:
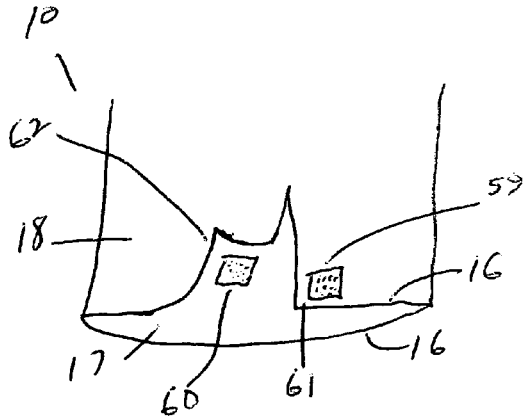

FIGS. 5A-5F depict various exemplary closure systems suitable for attaching one portion of a glove liner to another portion of the same glove liner. FIG. 5A depicts exemplary glove liner 10, upper fabric portion 17, lower fabric portion 18, edge portion 16, and zipper 51 suitable for joining glove liner portion 61 to glove liner portion 62. FIG. 5B depicts exemplary glove liner 10 and drawstrings 52 extending through opening 53 along edge portion 16, wherein drawstrings 52 are suitable for tightening exemplary glove liner 10 around a user's wrist along edge portion 16. FIG. 5C depicts exemplary glove liner 10, male snap portion 54, and female snap portion 55 suitable for joining glove liner portion 61 to glove liner portion 62. FIG. 5D depicts exemplary glove liner 10, button 56, and button hole 57 suitable for joining glove liner portion 61 to glove liner portion 62. FIG. 5E depicts exemplary glove liner 10 and adhesive 58 suitable for joining glove liner portion 61 to glove liner portion 62. FIG. 5F depicts exemplary glove liner 10, hook material 59, and loop material 60 suitable for joining glove liner portion 61 to glove liner portion 62.

In one exemplary embodiment of the present invention, the water-soluble glove liners comprise a closure system comprising one or more hoop and loop materials. The one or more hoop and loop materials may comprise water-insoluble materials, water-soluble materials, or water-dispersible materials as described above. Desirably, the one or more hoop and loop materials comprise water-soluble materials alone or in combination with one or additional components to form water-dispersible materials.

d. Chemical Treatments

The water-soluble glove liners may optionally be pretreated with a chemical treatment to enhance one or more properties selected from impermeability, permeability, flame resistance, moisture vapor permeability, tear strength, and stain resistance.

II. Methods of Making and Using the Water-Soluble Glove Liners

As discussed above, the water-soluble glove liners of the present invention may be made using any conventional method known in the art. Water-soluble fibers may be formed into a fabric using a weaving step, a knitting step, or a non-woven mat-forming step. In one desired embodiment, the water-soluble glove liners are formed by weaving polyvinyl alcohol fibers into one or more woven fabric sheets. In another desired embodiment, the water-soluble glove liners are formed by knitting polyvinyl alcohol fibers into one or more knitted fabric sheets. The woven or knitted fabric sheets are then cut to a desired size. Two or more woven or knitted fabric sheets are then joined to one another via one or more of the above-described sheet fastening devices, desirably, thread.

Figure 2:
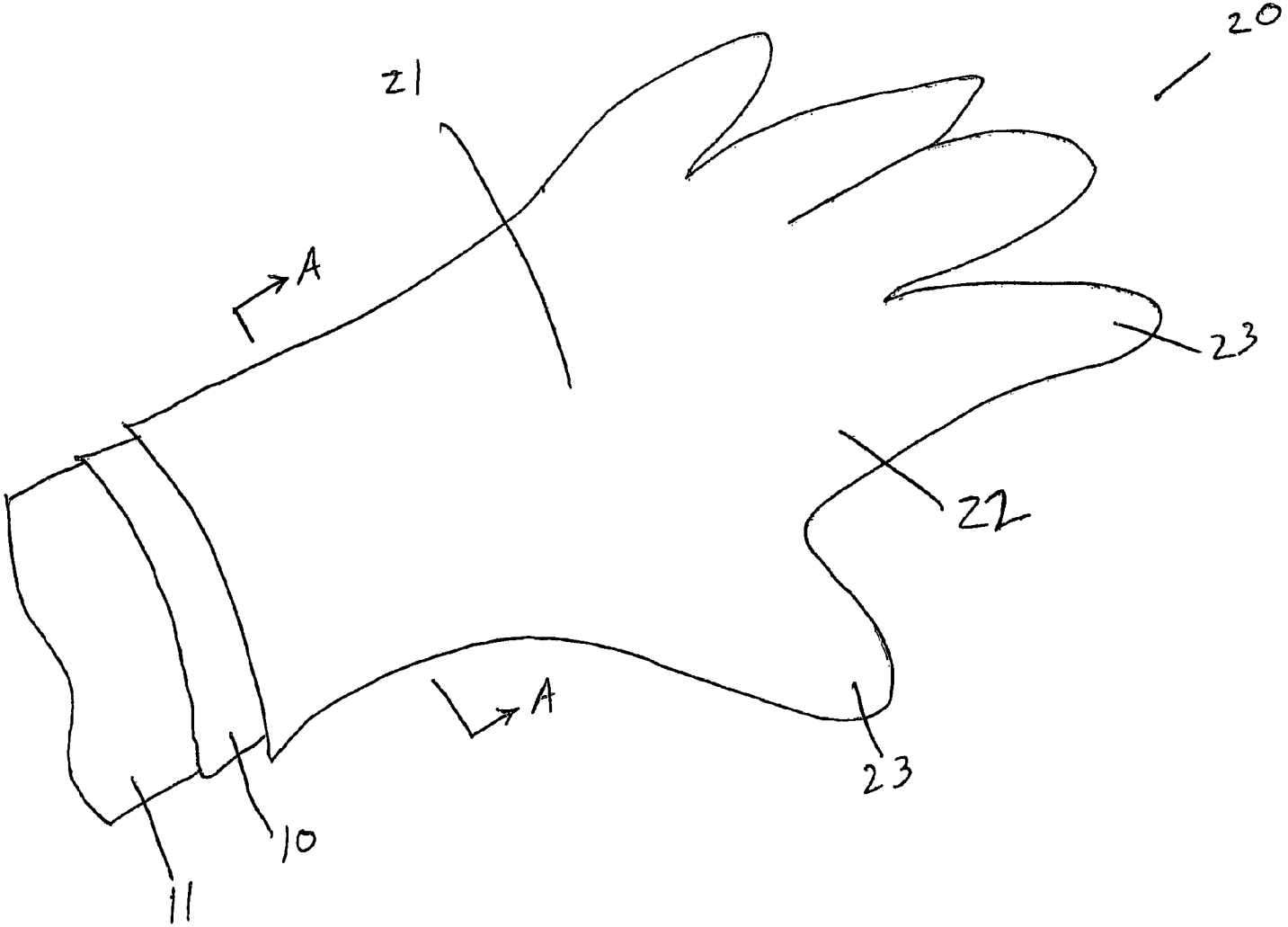
FIG. 2 depicts a view of the exemplary composite glove comprising the exemplary glove liner of FIG. 1 in combination with an outer glove.

The water-soluble glove liners of the present invention are typically used in combination with an outer glove, such as a rubber latex glove. Such a composite glove is shown in FIG. 2. As shown in FIG. 2, exemplary composite glove 20 comprises exemplary water-soluble glove liner 10, shown over a person's hand 11, and outer glove 21 positioned over a portion of exemplary water-soluble glove liner 10 and hand 11. Outer glove 21 comprises sheet 22 and fingers 23. Outer glove 21 may comprise any glove material including, but not limited to, rubber latex. Typically, outer glove 22 comprises a formed rubber latex glove comprising a single layer of rubber latex material, although glove 22 may comprise multilayer constructions.

FIG. 3 provides a cross-sectional view of exemplary composite glove 20 along line A-A shown in FIG. 2. As shown in FIG. 3, exemplary composite glove 20 comprises exemplary water-soluble glove liner 10 surrounding hand 11 with outer glove 21 surrounding exemplary water-soluble glove liner 10. Interface 26 separates outer glove 21 and exemplary water-soluble glove liner 10.

It should be noted that in some embodiments of the present invention, exemplary water-soluble glove liner 10 may be attached to outer glove 21 either temporarily (e.g., intended to be attached to one another but can be separated from one another with little effort such as when exemplary water-soluble glove liner 10 is tacked to outer glove 21 via a stitch or a spot adhesive) or permanently (e.g., not intended to be separated from one another).

The water-soluble glove liners and composite gloves of the present invention find particular utility in the nuclear industry. Water-soluble glove liners formed from polyvinyl alcohol provide absorbency, similar to cotton and other absorbent materials; however, unlike cotton, water-soluble glove liners formed from polyvinyl alcohol may be disposed of by solubilizing the polyvinyl alcohol. Further, the water-soluble glove liners of the present invention may be used in combination with an outer glove to provide contamination protection from radioactive material given that the water-soluble glove liners of the present invention alone do not provide adequate contamination protection from radioactive material. The water-soluble glove liners and composite gloves of the present invention can provide protection to workers in contaminated areas of a nuclear plant along with other protective clothing components including, but not limited to, coveralls, a hood, boot liners, rubber shoes or boots, and rubber gloves.

In one desired embodiment, the water-soluble glove liners of the present invention are used in combination with an outer glove, such as rubber latex gloves, and double-sleeve coveralls having an inner sleeve and an outer sleeve so as to provide protection to a worker from material in the nuclear industry. In this embodiment, a water-soluble glove liner of the present invention is placed over a person's hand. The inner sleeve of a double-sleeve coverall is pulled over a portion of the water-soluble glove liner so as to overlap a portion of the water-soluble glove liner. An outer glove, such as a rubber latex glove, is then placed over the person's hand, the water-soluble glove liner, and at least a portion of the inner sleeve of the double-sleeve coverall so as to overlap a portion of the inner sleeve of the double-sleeve coverall. The outer sleeve of the coverall is then pulled over a portion of the outer glove so as to overlap a portion of the outer glove. A cross-sectional view of such an embodiment is shown in FIG. 4.

Figure 4:
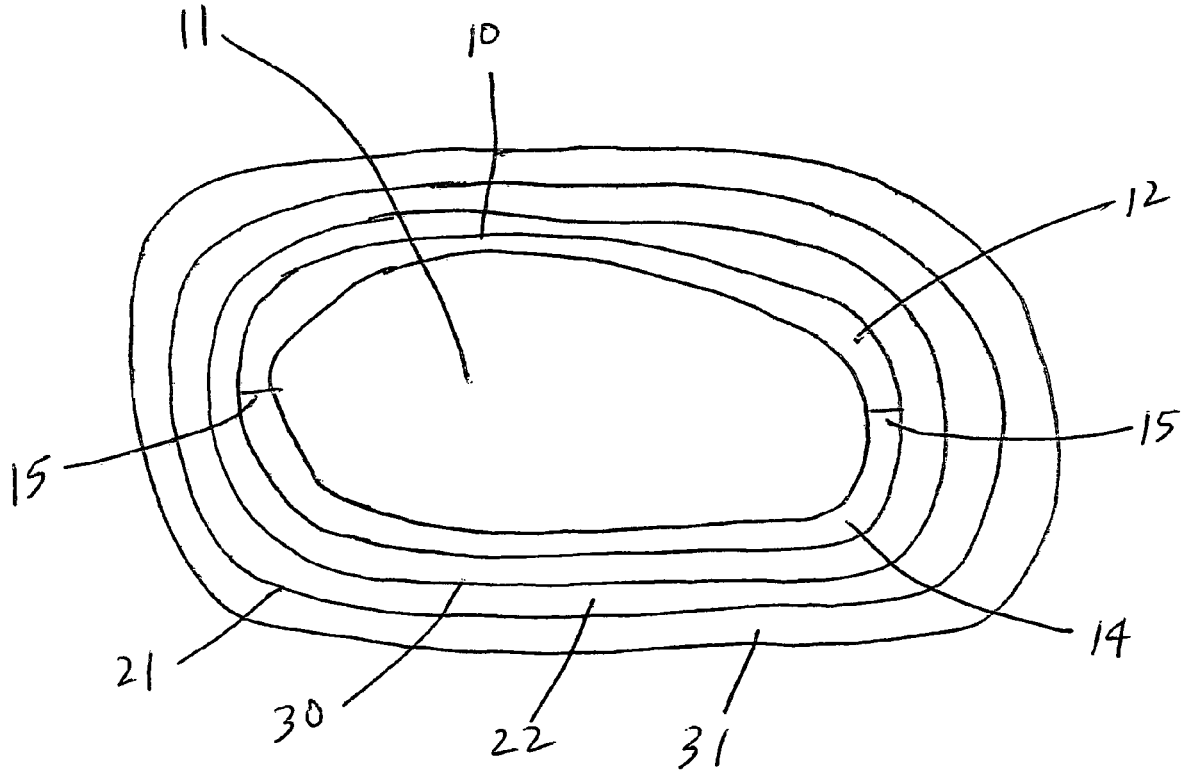
FIG. 4 depicts a cross-sectional view of the exemplary composite glove of FIG. 2 along line A-A when used in combination with a double-sleeve coverall having an inner sleeve and an outer sleeve.

As shown in FIG. 4, water-soluble glove liner 10 is positioned over hand 11. Inner sleeve 30 of a double-sleeve coverall (not shown) is pulled over a portion of water-soluble glove liner 10 so as to overlap water-soluble glove liner 10. Outer glove 21 is positioned over hand 11, water-soluble glove liner 10, and a portion of inner sleeve 30 so as to overlap a portion of inner sleeve 30 of the double-sleeve coverall. Outer sleeve 31 of the coverall is then positioned over a portion of outer glove 21 so as to overlap a portion of outer glove 21.

III. Method of Disposing of Water-Soluble Glove Liners

The present invention is further directed to methods of disposing of the above-described water-soluble glove liners. The methods of disposing of the above-described water-soluble glove liners may include, but are not limited to, any of the methods disclosed in U.S. Pat. No. 6,623,643, filed on Feb. 27, 2002; International Publication No. WO 01/36338 corresponding to PCT Application No. PCT/US00/26553; International Patent Application Serial No. PCT/US02/16184, filed on May 22, 2002; International Patent Application Serial No. PCT/US04/028839 filed on Sep. 7, 2004; and U.S. patent application Ser. No. 10/657,359, filed on Sep. 8, 2003; the subject matter of each of which is hereby incorporated by reference in its entirety.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A water-soluble glove liner consisting of:

at least two fabric sheets joined to one another with thread and configured to form glove liner portions consisting of a wrist portion, a palm portion, an upper hand portion, and finger portions extending from said palm portion and said upper hand portion, said glove liner portions in combination with one another being sized to fit onto and substantially cover a hand of a human being;

wherein each fabric sheet consists of water-soluble polyvinyl alcohol fibers.

2. The water-soluble glove liner of claim 1, wherein the thread is water-soluble thread.

3. The water-soluble glove liner of claim 1, wherein each fabric sheet is soluble in water having a water temperature of greater than about 37° C.

4. The water-soluble glove liner of claim 1, wherein each fabric sheet is soluble in water having a water temperature of greater than about 50° C.

5. The water-soluble glove liner of claim 1, wherein each fabric sheet is soluble in water having a water temperature of greater than about 75° C.

6. The water-soluble glove liner of claim 1, wherein each fabric sheet is soluble in water having a water temperature of greater than about 90° C.

7. A water-soluble glove liner consisting of:

at least two knitted fabric sheets joined to one another with at least one sheet fastening device and configured to form glove liner portions consisting of a wrist portion, a palm portion, an upper hand portion, and finger portions extending from said palm portion and said upper hand portion, said glove liner portions in combination with one another being sized to fit onto and substantially cover a hand of a human being;

wherein each knitted fabric sheet consists of water-soluble polyvinyl alcohol fibers, said water-soluble glove liner being contaminated with radioactive material generated in the nuclear industry.

8. The water-soluble glove liner of claim 7, wherein the at least one sheet fastening device consists of thread.

9. The water-soluble glove liner of claim 7, wherein said glove liner portions consist of a wrist portion, a palm portion, an upper hand portion and five finger portions extending from said palm portion and said upper hand portion.

* * * * *